United States Patent [19]

Barfield et al.

[11] Patent Number: 4,513,035

[45] Date of Patent: Apr. 23, 1985

[54] ORNAMENT

[76] Inventors: Michelle D. Barfield; George Spector, both of 233 Broadway, Rm 3615, New York, N.Y. 10007

[21] Appl. No.: 535,767

[22] Filed: Sep. 26, 1983

[51] Int. Cl.[3] ..... G10K 1/00

[52] U.S. Cl. ..... 428/11; 116/148

[58] Field of Search ..... D11/121, 125, 130; 116/148, 170, 171; 428/11

[56] References Cited

U.S. PATENT DOCUMENTS

| | | | |
|---|---|---|---|
| 1,217,675 | 2/1917 | Wilmsen | 428/11 |
| 2,749,637 | 6/1956 | Bradshaw | 428/11 |
| 2,749,638 | 6/1956 | Fiedler | 428/19 X |
| 3,132,988 | 5/1964 | Fowler | 428/11 |
| 3,533,890 | 10/1970 | Nesbit | 428/11 |
| 3,858,718 | 1/1975 | Roy | 428/192 X |
| 4,196,238 | 4/1980 | Wiggins | 428/11 |
| 4,309,464 | 1/1982 | Rauch | 428/11 |

*Primary Examiner*—Henry F. Epstein

[57] ABSTRACT

An ornament simulating a bell is provided and consists of a hollow generally conical shaped inverted cup, an outer covering placed about the cup, a hanger element disposed through top portion of the cup with one end affixed to a decorative element being spheroidal in shape simulating a bell clapper with other end of the hanger extending outwardly for attachment to a support from which said ornament is adapted to be supported.

2 Claims, 6 Drawing Figures

ORNAMENT

BACKGROUND OF THE INVENTION

The instant invention relates generally to decorative ornaments and more specifically it relates to an ornament simulating a bell.

Numerous decorative ornaments have been provided in prior art that are adapted to be used for decorating a christmas tree. For example, U.S. patents numbered U.S. Pat. Nos. 3,132,988; 4,196,238 and 4,309,464 all are illustrative of such prior art. While these units may be suitable for the particular purpose to which they address, they would not be as suitable for the purposes of the present invention as heretofore described.

SUMMARY OF THE INVENTION

A principal object of the present invention is to provide an ornament simulating a bell that has a hollow generally conical shaped inverted cup as its core.

Another object is to provide an ornament simulating a bell that has a decorative element being spheroidal in shape simulating a bell clapper or a very small bell to make a series of light clinking sounds like a tinkle.

An additional object is to provide an ornament simulating a bell that contains a plurality of pin hooks to enhance the design of the ornament.

A further object is to provide an ornament simulating a bell that is simple and easy to use.

A still further object is to provide an ornament simulating a bell that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
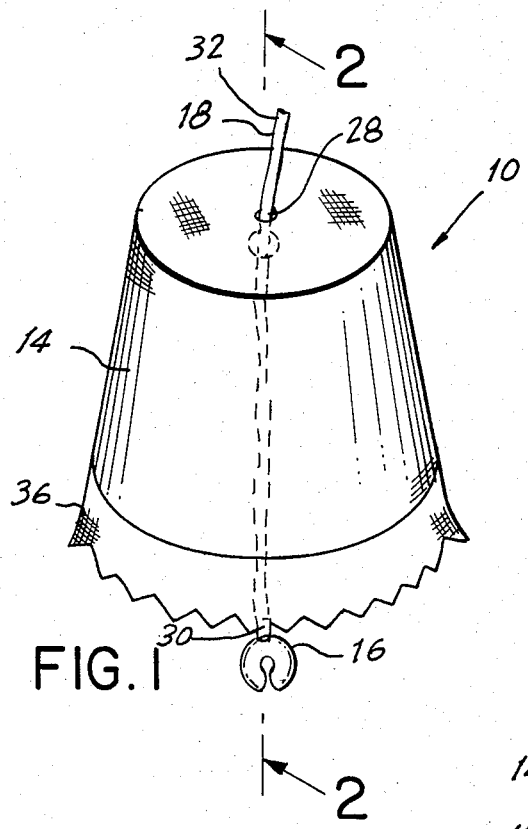
FIG. 1 is a perspective view of the invention
Figure 2:
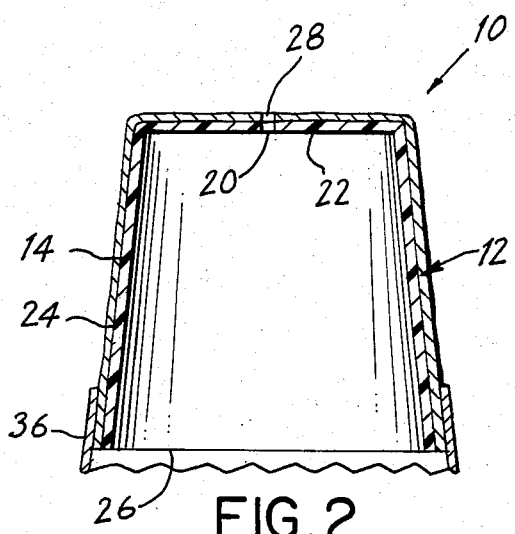
FIG. 2 is a cross sectional view taken along line 2—2 in FIG. 1.
Figure 3:
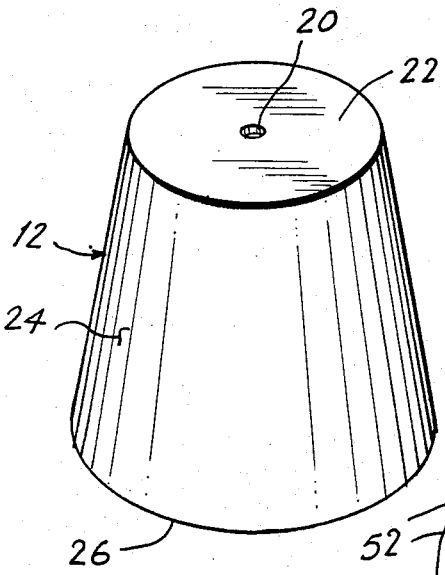
FIG. 3 is a perspective view of the plastic cup.

Turning now descriptively to the drawings, in which similar reference characters denote similar elements throughout the several views, FIGS. 1 through 3 illustrates an ornament 10 simulating a bell. The ornament 10 consists of a hollow generally conical shaped inverted cup 12, an outer covering 14, a decorative element 16 and a hanger element 18.

The cup 12 has an aperture 20 in top portion 22, an outer skin forming an exterior surface 24 and an open bottom mouth 26. The outer covering 14 is placed about the exterior surface 24 of the cup 12 and hold in place by sewing, gluing or the like. The covering 14 has an aperture 28 in alignment with the aperture 20 in the cup 12.

Figure 6:
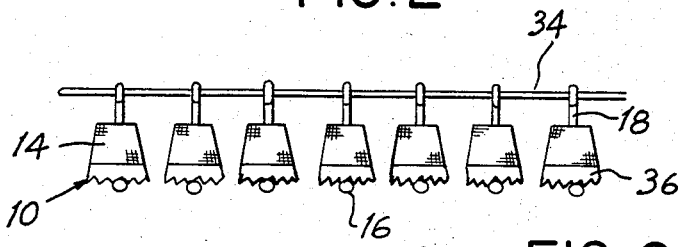
FIG. 6 is a front elevational view showing a series of ornaments in an assembled form.

The decorative element 16 is spheroidal in shape simulating a bell clapper. The hanger element 18 is disposed through the aperture 28 in the outer covering 14 and the aperture 20 in the cup 12. One end 30 of the hanger element 18 is affixed to the decorative element 16 with other end 32 of the hanger element 18 extending outwardly from the top portion 22 of the cup 12 for attachment to a support 34 from which the ornament 10 is adpated to be supported. A series of ornaments 10 is shown in FIG. 6 all attached to the support 34.

A trim 36 can be placed about bottom edge of the outer covering 14 by sewing, gluing or the like to form an ornamental design thereof. The outer covering 14 and the trim 36 is made of cloth material. The cloth material of the outer covering 14 can be of a different color than the cloth material of the trim 36.

The decorative element 16 is a very small bell to make a series of light clanking sounds like a tinkle. The hanger element 18 is a strand of material and the cup 12 is made of molded cellular polystyrene material.

Figure 4:
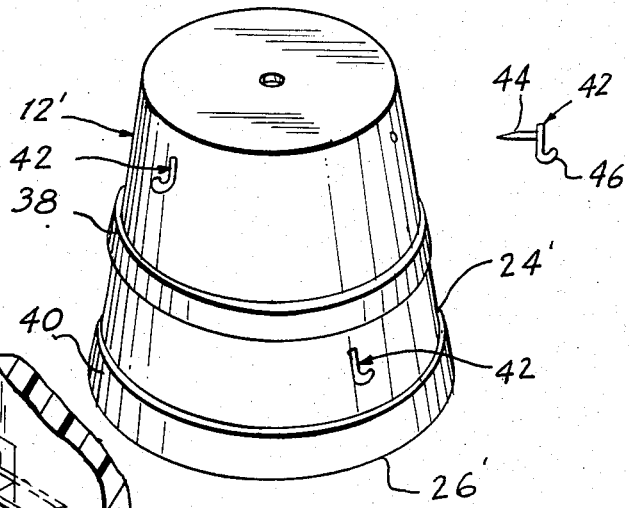
FIG. 4 is a perspective view of a modified plastic cup showing two ribs and plug in pin hooks.

In FIG. 4 the cup 12' further contains two ribs 38 and 40. Rib 38 is formed around middle of the exterior surface 24' while rib 40 is formed around bottom of the exterior surface 24' near the open bottom mouth 26'. The ribs 38 and 40 will give support to the cup 12' and enable the cloth material to better engage the exterior surface 24' of the cup 12'. A plurality of pin hooks 42 are placed around the exterior surface 24'. Each pin hook 42 consists of two parts, a pin 44 and a hook 46 so that the pin hooks 42 can engage the cloth material and enhance the design of the ornament 10.

Figure 5:
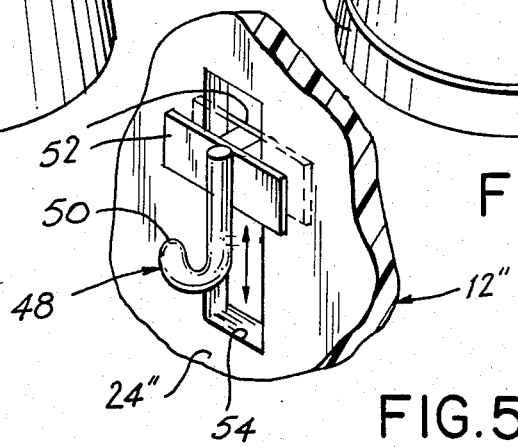
FIG. 5 is a partial perspective view of a pin hook that is adjustable vertically to the cup thereof.

In FIG. 5 an adjustable pin hook 48 is illustrated in detail. The pin hook 48 has a hook portion 50 attached to a slideable track 52 built into the exterior surface 24'' of the cup 12'' at slot 54. The pin hook 48 is vertically adjustable to the cup 12'' thereof.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An ornament simulating a bell comprising:

(a) a hollow generally conical shaped inverted cup having an aperture in top portion, an outer skin forming an exterior surface and an open bottom mouth thereof;

(b) an outer covering placed about the exterior surface of said cup, said covering having an aperture in alignment with the aperture in said cup;

(c) a decorative element being spheroidal in shape simulating a bell clapper; and (d) a hanger element disposed through the aperture in said outer covering and the aperture in said cup, one end of said hanger element affixed to said decorative element with other end of said hanger element extending outwardly from the top portion of said cup for attachment to a support from which said ornament is adapted to be supported, further comprising a trim placed about bottom edge of said outer covering to form an ornamental design thereof, wherein said outer covering and said trim is made of cloth material, said cloth material of said outer covering being of a different color than said cloth material of said trim, wherein said decorative element is a very small bell to make a series of light clinking sounds like a tinkle, wherein said hanger element is a strand of material and said cup is made of molded cellular polystyrene material, wherein (e) two ribs, one rib formed around middle of the exterior surface and the other rib formed around bottom of the exterior surface near the open bottom mouth so that said ribs will give support to said cup and enable said cloth material to better engage the exterior surface of the cup; and (f) a plurality of pin hooks placed around the exterior surface so that said pin hooks can engage said cloth material and enhance the design of the ornament.

2. An ornament as recited in claim 1, wherein each said pin hook comprises a slideable track built into the exterior surface of said cup so that each said pin hook is vertically adjustable to said cup thereof.

* * * * *